US006402112B1

(12) United States Patent
Thomas et al.

(10) Patent No.: US 6,402,112 B1
(45) Date of Patent: Jun. 11, 2002

(54) ADJUSTABLE MECHANISM WITH LOCKING BRAKE

(75) Inventors: Eric P. Thomas, Little Compton; Daniel F. Francis, Warren, both of RI (US); Orlando S. Rodrigues, Swansea, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/608,089

(22) Filed: Jun. 30, 2000

(51) Int. Cl.[7] ..... A47H 1/10; F21S 1/06

(52) U.S. Cl. ..... 248/317; 248/318; 248/343; 248/324; 362/365; 362/371

(58) Field of Search ..... 248/317, 318, 248/324, 327, 343, 314, 906; 362/365, 269, 147, 364, 372, 453, 404, 427, 371

(56) References Cited

U.S. PATENT DOCUMENTS

| | | | | | |
|---|---|---|---|---|---|
| 2,922,030 | A | | 1/1960 | Bobrick | |
| 3,182,187 | A | | 5/1965 | Gellert | |
| 3,609,346 | A | * | 9/1971 | Lund | 362/364 |
| 4,745,533 | A | * | 5/1988 | Smerz | 362/364 |
| 5,130,914 | A | * | 7/1992 | Bengochea | 362/364 |
| 5,291,381 | A | | 3/1994 | Price | |
| 5,452,193 | A | | 9/1995 | Hinnefeld et al. | |
| 5,538,214 | A | * | 7/1996 | Sinila | 248/278.1 |
| 5,562,343 | A | * | 10/1996 | Chan et al. | 362/365 |
| 5,564,815 | A | | 10/1996 | Littman et al. | |
| 5,630,663 | A | | 5/1997 | Ling et al. | |
| 5,669,324 | A | * | 9/1997 | Muir, III | 114/194 |
| 5,951,151 | A | * | 9/1999 | Doubeck et al. | 362/365 |
| 6,142,439 | A | * | 11/2000 | Aramaki | 248/327 |
| 6,145,798 | A | * | 11/2000 | Janisse et al. | 248/324 |
| 6,343,873 | B1 | * | 2/2002 | Eberhard et al. | 362/147 |

* cited by examiner

*Primary Examiner*—Anita King
*Assistant Examiner*—Naschica S. Morrison
(74) *Attorney, Agent, or Firm*—Charles G. Lamb; Jeffrey A. Haeberlin; Middleton Reutlinger

(57) ABSTRACT

The present invention provides a support assembly for a lighting fixture that allows for the adjustment and positioning of a lamp about both a horizontal and a vertical axis using only one locking mechanism. The support assembly includes a first support member that is pivotably attached to a second support member. The support assembly also includes a cylindrical sleeve to which the second support member is adjustably engaged. Both support members include at least one leg extending therefrom. The locking mechanism includes a pivoting brake shoe that can engage the cylindrical sleeve so as to secure the lamp into position about a vertical axis. The locking mechanism also includes a thumbscrew that is housed within a slot defined within a leg of the first support member, and that engages both the brake shoe and a leg on the second support member.

16 Claims, 4 Drawing Sheets

ADJUSTABLE MECHANISM WITH LOCKING BRAKE

BACKGROUND

1. Field of the Invention

The present invention relates to lighting fixtures and, more particularly, to recessed lighting fixtures with adjustable support assemblies including locking mechanisms therefor.

2. Description of the Related Art

Many recessed lighting fixtures allow for adjustment of the fixture about both a horizontal and a vertical axis. These fixtures provide a means for securing the fixture about the horizontal axis and another separate means for securing it about the vertical axis. However, current lighting fixtures fail to provide for a single means that will conveniently secure the fixture about both axes. Additionally, current adjustable fixtures tend to become misaligned after they have been adjusted into position due to adjustment mechanisms that do not provide a smooth stable adjustment. This misalignment is especially prevalent during relamping of the fixture. These adjustable fixtures also usually provide only a limited range of adjustment that will not allow the user to optimize the use of the lighting fixture after it has been installed.

Thus, there is a need for an adjustment mechanism for a recessed lighting fixture that provides for a wide range of adjustment and the securing of the assembly by the convenient use of a single locking mechanism. The mechanism should also provide for a smooth stable adjustment that maintains the lamp in position, once it has been so adjusted.

SUMMARY OF THE INVENTION

It is an object of the present invention to provide a support assembly for a lighting fixture that provides for a significant range of adjustable positioning for the lamp within the fixture.

It is another object of the present invention to provide a support assembly for a lighting fixture that maintains its position once it has been adjustably placed therein.

It is yet another object of the present invention to provide a support assembly that provides a single mechanism by which securing of the fixture about both a horizontal and a vertical axis is conveniently achievable.

It is a further object of the present invention to provide a support assembly for a lighting fixture that provides for unlimited positioning within a specified range of adjustment.

More particularly, the present invention provides a support assembly for a lighting fixture with two adjustment mechanisms that provide for a significant range of adjustment of the lamp within the lighting fixture, and the securing of the lamp by means of a single locking mechanism. The support assembly includes a first and a second support member. The first support member may be an arcuate support brace or yoke, including at least one first leg extending therefrom. This first leg may include a slot therein. The second support member may be an annular base brace or yoke which is spaced from first support member and includes at least a second leg extending therefrom. The second leg of the second support member may include an opening therein. The first support member is pivotably attached to the second support member by a fastening means extending through the slot of the first leg and the opening of the second leg. The support assembly also includes a brake shoe which is in releasable communication with a cylindrical sleeve which is concentrically aligned with the second support member. The support assembly also includes a locking means or fastening means, preferably a screw and, more particularly, a thumbscrew, disposed within the slot of the first leg of the first support member. The locking means is also in communication with a second leg of the second support member.

The first adjustment mechanism provides for the repositioning of the lamp support about a horizontal axis. This first adjustment mechanism includes at least one pivot pin, in communication with both a second leg of the second support member and the brake shoe. The first adjustment mechanism also includes a biasing pin that is attached to one leg of the annular base brace or yoke and which is in communication with the arcuate support yoke, and a locking means, preferably an adjustable locking screw or similar fastening means, that is disposed within the slot of the support yoke and is also attached to a leg of the base yoke. The communication of the biasing pin and the locking screw with the support yoke may be, more particularly, with one or more legs of the support yoke, wherein each pin is housed within a slot defined within a leg of the support yoke. The support yoke pivots on its leg about the pivot pin. In this manner, the entire support yoke can pivot in an arc defined by the slot relative to the base yoke. Thus, a lamp attached to this support yoke can be pivoted to any point within this arc.

The second adjustment mechanism includes the base brace or yoke, a cylindrical sleeve with a flange projecting therefrom, an adjustable brake shoe that secures the base yoke in position relative to the cylindrical sleeve, a pivoting means in communication with both a second leg of the second support member and the brake shoe, and locking screw of the first adjustment mechanism. The cylindrical sleeve is attached to the rest of the lighting fixture, or the wall or ceiling in which the fixture is disposed and provides a means of support for the support assembly and the lamp socket attached thereto. The base yoke may be rotated 358° about a vertical axis that runs through the center of the annular portion of the yoke and then secured in position within the lighting fixture by the adjustable locking brake. The adjustable locking brake may be loosened, so as to allow the rotation of the base yoke, and then tightened so as to lock the base yoke into position. When the locking brake is tightened, it moves about the pivoting means, which is preferably a ledge. The lower end of the locking brake pivots outward to frictionally engage the cylindrical sleeve, thereby securing the base yoke into position relative to the sleeve. Thus, the brake shoe is in releasable communication with the cylindrical sleeve. The securing of this adjustable locking brake is accomplished by the locking screw of the first adjustment mechanism.

The single consolidated locking mechanism therefore includes the locking screw, which extends through both the slot defined within the leg of the support yoke and a hole defined within the leg of the base yoke and which finally attaches to the brake shoe, the brake shoe and the cylindrical sleeve. The locking screw, support leg and base leg cooperate with each other to secure the support yoke about the horizontal axis, while the locking screw, brake shoe, base leg and cylindrical sleeve cooperate to secure the base yoke about the vertical axis. The brake shoe may be in releasable communication with any convenient surface, such as a surface on the cylindrical sleeve, such that it prevents movement of the second support member when frictionally engaged to that surface. The tightening of the locking screw simultaneously causes the cooperation of the elements of the locking mechanism so as to cause the locking of the assembly in place relative to both axes.

The combination of the two adjustment mechanisms provides for a wide range of adjustment of the lamp within the lighting fixture. The arc of the first adjustment mechanism is effectively doubled for any diametrical alignment by the addition of the second adjustment assembly. The addition of the consolidated locking mechanism to the two adjustment mechanisms provides for ease and convenience in the repositioning of the lamp.

It will become apparent that other objects and advantages of the present invention will be obvious to those skilled in the art upon reading the detailed description of the preferred embodiment set forth hereinafter.

DESCRIPTION OF THE PREFERRED EMBODIMENT

As shown in the figures, a support assembly 10 with a locking mechanism for a recessed lighting fixture of the present invention is provided. The support assembly 10 includes a first support member which is a support brace or yoke 20 and a second support member which is a base brace or yoke 40. A lamp socket, not shown, is attached to support yoke 20 when the assembly 10 is included within a lighting fixture. When the lighting fixture is completely assembled and installed, a lamp (not shown) is housed within the lamp socket (not shown) that is attached to the support yoke 20. The lamp is directed down through opening 49 of base yoke 40.

Figure 1:
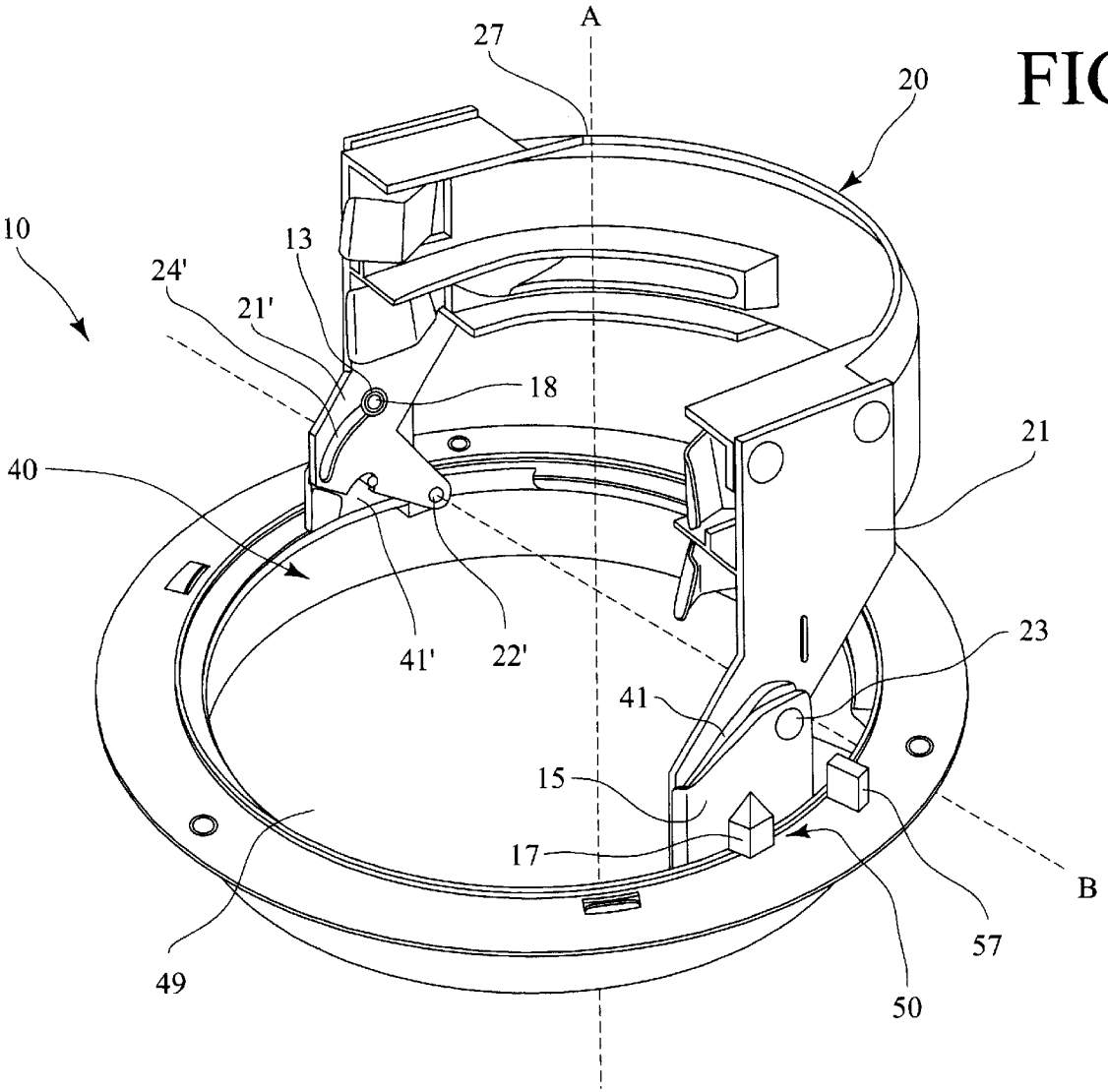
FIG. 1 is a perspective view of a preferred embodiment of a support assembly with locking mechanism for a lighting fixture of the present invention.

As shown in FIG. 1, support yoke 20 includes support legs 21 and 21' and base yoke 40 includes base legs 41 and 41'. Support yoke 20 also may include a U-shaped member 27 to which a lamp socket (not shown) may be attached. Support leg 21 is pivotably attached to base yoke 40 by pivot pin 22, shown in FIG. 2. Support leg 21' is likewise adjustably attached to base yoke 40 by pivot pin 22'. Both support legs 21 and 21' pivot about pivot pins 22 and 22' relative to base yoke 40. Support legs 21 and 21' also include slots 24 and 24', respectively. Biasing pin 18 extends through slot 24' in support leg 21' and is attached to base leg 41'. A biasing means, which may be either biasing washer 13 or biasing pin 18, is in frictional communication with the first support member, support yoke 20, so as to inhibit the movement of the first support member about a horizontal axis "B". More specifically, biasing pin 18 may frictionally engage support leg 21' so that support leg 21' will remain stationary when no outside force is applied to the support yoke 20. Alternatively, biasing washer 13, when disposed on biasing pin 18, may frictionally engage support leg 21' so as to maintain it in a stationary position. In this manner, support yoke 20 will remain stationary even when the locking mechanism of the present invention is disengaged.

Figure 3:
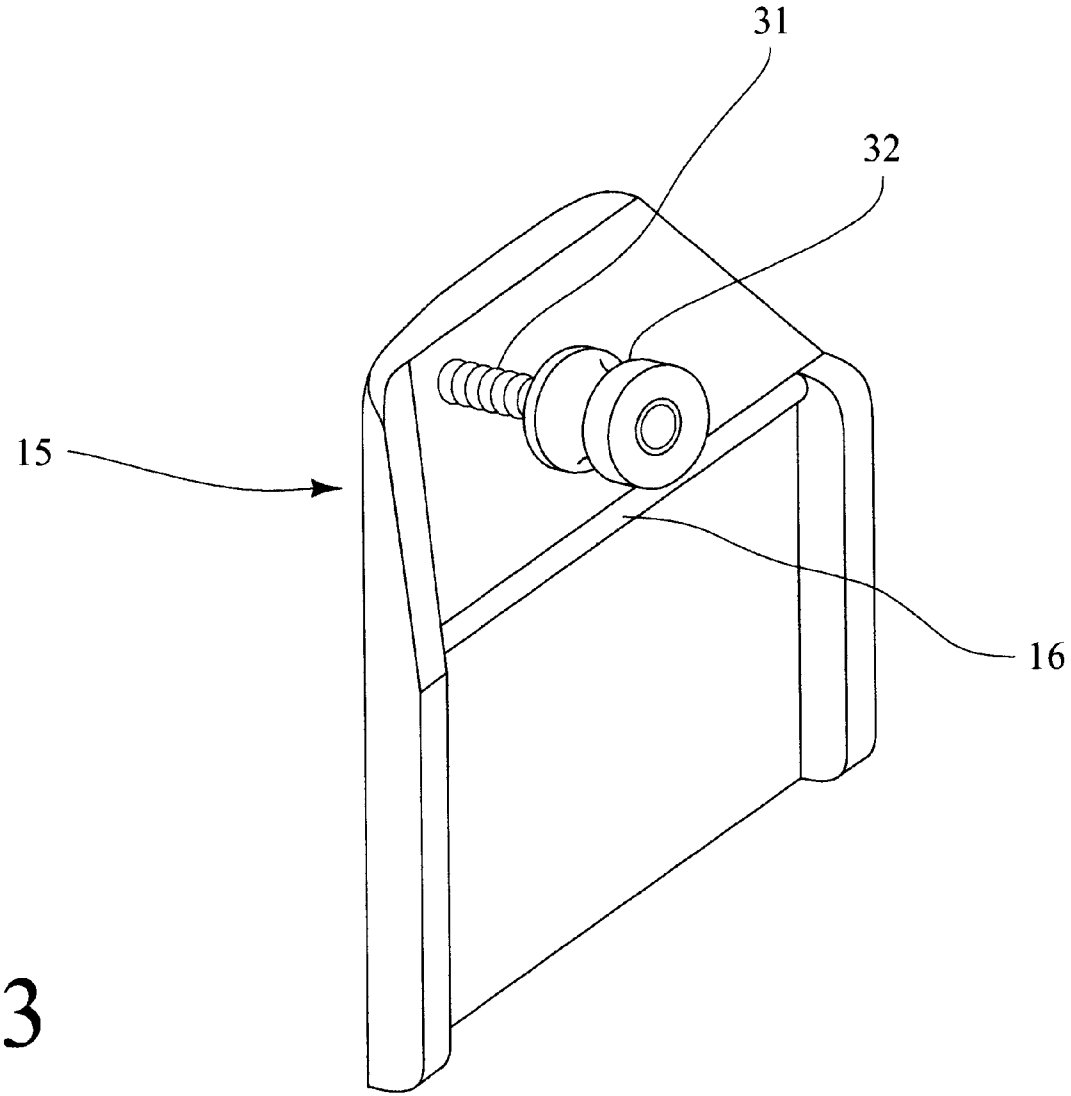
FIG. 3 is a perspective view of the locking brake and locking screw of the present invention.
Figure 4:
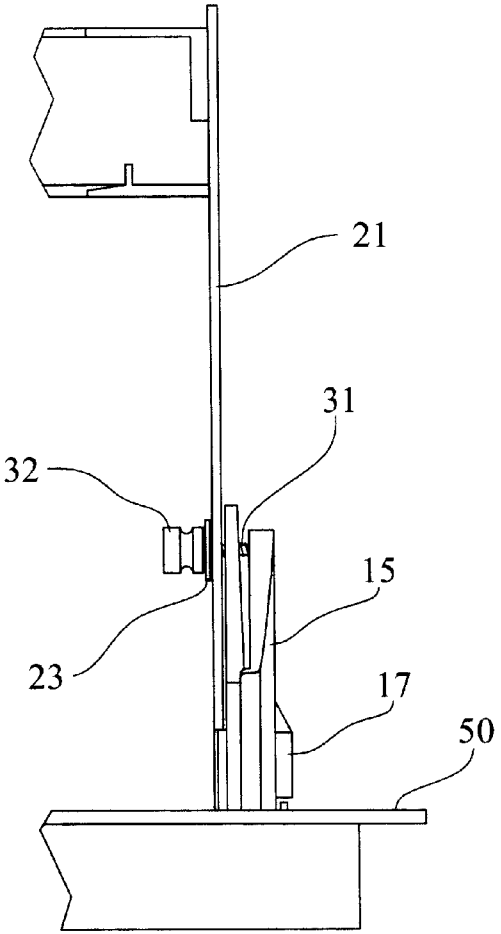
FIG. 4. is front view of the locking mechanism of the present invention in a secure position.

FIG. 1 also shows brake shoe 15 whose lower end is movably disposed between base leg 41 and a cylindrical sleeve 50 which defines opening 49. Base yoke 40 may be disposed concentrically within cylindrical sleeve 50. Cylindrical sleeve 50 may include one or more support members (not shown) that attach cylindrical sleeve 50 to base yoke 40, but allow the axial movement of base yoke 40 relative to cylindrical sleeve 50. Brake shoe 15 is attached to support leg 21 and base leg 41 by locking screw 23. Locking screw 23 extends through slot 24 defined in support leg 21 and an opening (not shown) defined in base leg 41. As shown in FIG. 3, locking screw 23 may include two elements—a threaded shaft 31 and a detachable thumbscrew head 32. Brake shoe 15 includes a pivot shoulder or ledge 16, also shown in FIG. 3. When brake shoe 15 is attached to the support assembly of the present invention, pivot shoulder or ledge 16 faces base leg 41. When locking screw 23 is tightened the upper portion of brake shoe 15 is drawn toward base leg 41 and support leg 21. When locking screw 23 is tightened, the contact of pivot shoulder 16 with the side of base leg 41 causes the lower portion of brake shoe 15 to pivot away from base leg 21. The lower portion of brake shoe 15 may thereby frictionally engage the inner shoulder of cylindrical sleeve 50, as shown in FIG. 4. Alternatively, the lower portion of brake shoe 15 may frictionally engage any appropriate surface of the light fixture or surrounding structure. This frictional engagement secures the base yoke 40 relative to the cylindrical sleeve 50 and prevents movement about a vertical axis "A". Alternatively, pivot shoulder 16 may be disposed on base leg 41 and accomplish the same function.

Figure 5:
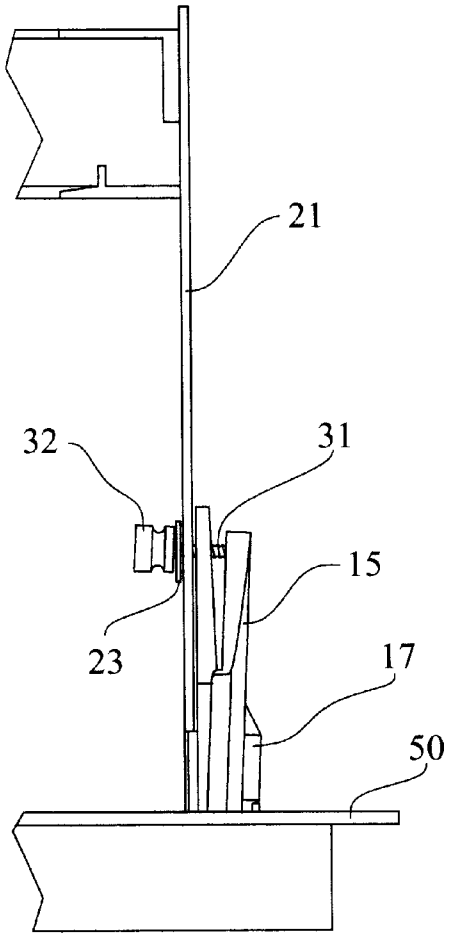
FIG. 5 is a front view of the locking mechanism of the present invention in an unsecured position.

In contrast, FIG. 5 shows locking screw 23 in a loosened state. When locking screw 23 is positioned in a loosened state, brake shoe 15 does not pivot on pivoting shoulder or ledge 16 and, thus, does not frictionally engage the inner shoulder of cylindrical sleeve 50. As a result, base yoke 40 is free to move relative to cylindrical sleeve 50. When the brake shoe 15 is not engaging the inner wall of the cylindrical sleeve 50, the only limitation on the rotation about vertical axis "A" for base yoke 40 is the engagement of tab 17, located on brake shoe 15, with stop 57 located on the cylindrical sleeve 50, shown in FIG. 1.

Figure 2:
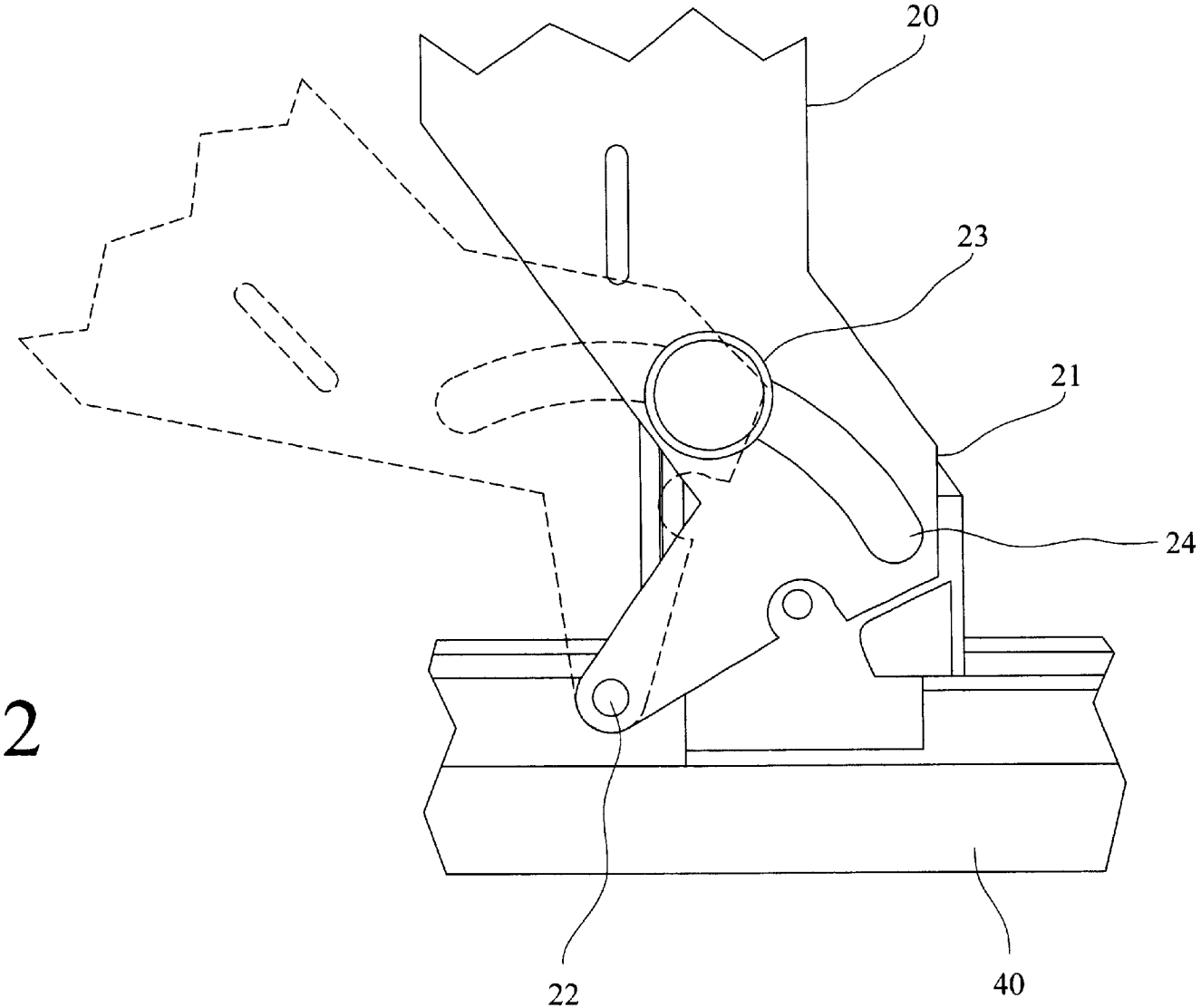
FIG. 2 is an inner side view of locking mechanism of the present invention showing the leg of the support yoke in an upright position and in a reclined position in phantom lines.

FIG. 2 shows the rotation of support yoke 20 about the horizontal axis "B". Support yoke 20 pivots on pivot pin 22, thereby allowing for the redirecting of a lamp attached to support yoke 20. When locking screw 23 is loosened, support yoke 20 is movable through an arc defined by slot 24 in leg 21 of support yoke 20. When locking screw 23 is tightened, it frictionally engages leg 21 while simultaneously bringing support leg 21 into frictional engagement with base leg 41. These frictional engagements between the locking screw 23, the leg 21 and support leg 41 prevent movement of support yoke 20 about a horizontal axis "B", shown in FIG. 1. Thus, the support yoke 20 may be secured relative to base yoke 40 by the use of the locking mechanism which includes locking screw 23.

Once the lighting fixture containing the support assembly 10 of the present invention is installed, the lamp light of the fixture may be redirected by adjusting the support assembly mechanisms and then securing them with the one locking mechanism. The position of the lamp about a horizontal axis may be adjusted by manipulating the first adjustment mechanism of the present invention. The lamp and lamp socket, which are suspended from the support yoke, may be repositioned at any point within the arc defined by slots 24 and 24' about horizontal axis "B" that extends through pivot pins 22 and 22', as best shown in FIG. 2. Once the support yoke 20 is in the desired position relative to the horizontal axis "B", biasing washer 13 or biasing pin 18 frictionally engages support leg 21' so that the support yoke remains in the desired position.

When the brake shoe 15 is in the loosened state, as shown in FIG. 5, the lamp may then be repositioned about the vertical axis "A" at any point within a 358° arc. Once the base yoke 40 is rotated into the desired position within this arc, locking screw 23 may then be tightened, thereby causing brake shoe 15 to pivot on pivot shoulder 16. Brake shoe 15 pivots out to frictionally engage cylindrical sleeve 50, thereby securing base yoke 40 in the desired position. As locking screw 23 is being tightened, it is simultaneously frictionally engaging support leg 21, thereby securing support yoke 20 in the desired position. Thus, the lamp is secured in the desired position relative to both vertical axis "A" and horizontal axis "B" by the tightening of locking screw 23. The lamp supported by support assembly 10 of the present invention may, therefore, be adjusted into any position within the two arcs defined by the support assembly 10 and secured by the singular motion of tightening locking screw 23.

While the invention has been found in one preferred embodiment in respect to the design of the locking and adjustment mechanisms of the support assembly for a lighting fixture, it is apparent that various modifications can be made to the present invention without departing from the spirit or scope of the invention as set forth in the claims appended hereto.

What is claimed is:

1. A support assembly for a lighting fixture comprising:

a first support member including at least one first leg extending therefrom, said at least one first leg including a slot therein;

a second support member spaced from said first support member and including at least one second leg extending therefrom, said first support member pivotably attached to said second support member;

a brake shoe;

a locking means disposed within said slot of said at least one first leg and in communication with said at least one second leg and said brake shoe attaching said at least one first leg and said at least one second leg to said brake shoe;

a pivoting means in communication with said at least one second leg and said brake shoe;

a cylindrical sleeve concentrically aligned with said second support member, wherein said brake shoe is in releasable communication with said cylindrical sleeve whereby adjustment of said locking means prevents movement of the support assembly along both horizontal and vertical axes.

2. The support assembly of claim 1, wherein said locking means is a screw.

3. The support assembly of claim 2, wherein said screw is a thumbscrew.

4. The support assembly of claim 1, wherein said pivoting means is a ledge.

5. The support assembly of claim 1, wherein said cylindrical sleeve includes a flange extending therefrom.

6. The support assembly of claim 1, wherein said second support member is annular.

7. The support assembly of claim 1, wherein said second support member is housed within said cylindrical sleeve.

8. The support assembly of claim 1, wherein said cylindrical sleeve includes at least one support member.

9. The support assembly of claim 1, wherein said brake shoe includes a first stop lug projecting therefrom; and, said cylindrical sleeve includes a second stop lug projecting therefrom so as to engage said first stop lug.

10. The support assembly of claim 1, wherein said first support member includes a U-shaped member.

11. The support assembly of claim 1, further comprising a biasing means in frictional communication with said first support member, whereby said biasing means inhibits movement of said first support member about a horizontal axis.

12. The support assembly of claim 11, wherein said biasing means is a washer.

13. The support assembly of claim 11, wherein said biasing means is a pin.

14. A locking mechanism for a lighting fixture comprising:

a pivoting first leg including a slot therein;

a second leg including an opening therein;

a brake shoe;

a fastening means extending through said slot and said opening and attaching said brake shoe to said first leg and said second leg;

a pivoting means in communication with said brake shoe and said second leg;

a surface positioned adjacent said brake shoe, wherein said brake shoe is in releasable communication with said surface and whereby adjustment of said fastening means prevents movement of the lacking mechanism along both horizontal and vertical axes.

15. The locking mechanism of claim 14, wherein said fastening means is a screw.

16. The locking mechanism of claim 14, wherein said fastening means is a thumbscrew.

* * * * *

UNITED STATES PATENT AND TRADEMARK OFFICE

CERTIFICATE OF CORRECTION

PATENT NO. : 6,402,112 B1 
DATED : June 11, 2002
INVENTOR(S) : Eric P. Thomas, Daniel F. Francis and Orlando S. Rodrigues It is certified that error appears in the above-identified patent and that said Letters Patent is hereby corrected as shown below:

Column 5,
Line 41, insert -- , said locking means -- after "brake shoe"
Line 49, insert -- , and -- after "sleeve"

Column 6,
Line 44, change "lacking" to -- locking --

Signed and Sealed this

Twenty-second Day of October, 2002

*Attest:*

*Attesting Officer*

JAMES E. ROGAN
*Director of the United States Patent and Trademark Office*